United States Patent [19]

Dauvergne et al.

[11] 4,262,635

[45] Apr. 21, 1981

[54] FREE-EXPANSION BOILER WITH REPLACEABLE HEAT EXCHANGER TUBES

[76] Inventors: Hector A. Dauvergne, P.O. Box 884, San Leandro, Calif. 94577; C. William Moore, P.O. Box 756, Pleasanton, Calif. 94566

[21] Appl. No.: 50,621

[22] Filed: Jun. 21, 1979

[51] Int. Cl.[3] ..... F22B 37/10

[52] U.S. Cl. ..... 122/235 C; 122/235 E; 122/365

[58] Field of Search ..... 122/235 C, 235 D, 235 E, 122/223, 224, 225 B, 230, 203, 353, 354, 365, 489, 509

[56] References Cited

U.S. PATENT DOCUMENTS

| | | | |
|---|---|---|---|
| 1,005,333 | 10/1911 | Schreier | 122/365 |
| 1,021,204 | 3/1912 | McNaull | 122/365 |
| 1,621,505 | 3/1927 | Hartmann et al. | 122/235 E |
| 1,980,785 | 11/1934 | Coulson, Jr. | 122/235 E |
| 1,980,820 | 11/1934 | Nerad | 122/235 E |
| 2,184,333 | 12/1939 | Biggs | 122/235 E |
| 2,209,974 | 8/1940 | Jacobus | 122/365 |
| 2,327,750 | 8/1943 | Turner | 122/235 C |

*Primary Examiner*—Henry C. Yuen
*Attorney, Agent, or Firm*—Bielen and Peterson

[57] ABSTRACT

A boiler having an elevated water supply, steam collector drum with a plurality of depending heat exchange tubes, the tubes being connected to the drum to provide a supply path for water from the boiler drum and a return path for steam and water to the boiler drum, the tubes being connected to a single drum facilitating the removal and replacement of defective tubes and servicing of the drum.

12 Claims, 6 Drawing Figures

FREE-EXPANSION BOILER WITH REPLACEABLE HEAT EXCHANGER TUBES

BACKGROUND OF THE INVENTION

This invention relates to a steam boiler for use in a furnace that may be coal fired, oil fired, or using other conventional fuels including particularly combustible refuse and trash typical of municipal collection centers. Steam boilers are an efficient means of converting bulk fuel into usable energy. Using boilers to supply steam engines or steam turbines, the heat energy of the fuels can be conveniently converted to mechanical work, which may subsequently be converted to electrical energy. Modern boiler and furnace designs have evolved to a highly efficient state. Typically, the boiler design utilizes an overhead water storage drum connected to a lower base storage drum by a multiplicity of selectively bent tubes. The arrangement of the upper and lower drums and the tubes is integrally related to the design of the furnace combustion chamber. Furthermore, the tube and drum arrangement and the furnace design is usually adapted for a specific type of fuel. For example, a boiler system utilizing coal would be designed differently than a system utilizing petroleum oil or gas as its fuel.

In achieving the high efficiencies of modern boiler and furnace designs, there has been a sacrifice of not only versatility but also ease of repair. A primary cause of boiler failure is the bursting or leaking of one or more of the many tubes interconnecting the upper and lower drums. Replacement of these tubes is extremely difficult because of the attachment of both ends of the tubes to displaced drums. Since the tubes are welded or in lower temperature systems brazed to the respective drums, selective replacement involves not only carefully separating the defective tube from the drums but difficult tasks of inserting, aligning, and welding the replacement tube to the drums.

In many situation, it is not necessary to achieve the high efficiencies that conventional boilers are achieving. The reasons may be varied. Boiler and furnace may be located in an area in which there are plentiful supplies but skilled technicians are unavailable. Or, the fuel being used in the furnace either is variable, that is consisting of different materials at different times, as is the nature of refuse and trash always inconsistent, burning at different temperatures and intensities. In these situations, a boiler that is dependable, heavy-duty, and easily repaired is preferable to one that is highly efficient but lacking in these other more mundane qualities. Also as important as the performance of the boiler is the capital investment involved. The boiler devised in this invention is designed to provide a moderately efficient boiler which is easily repairable and has a low initial capital cost and can operate in an unsophisticated furnace which is designed to utilize variable and different fuels.

The single drum boiler design of this invention basically sacrifices a degree of efficiency for substantial benefits in convenience and reduced capital cost.

SUMMARY OF THE INVENTION

The boiler of this invention comprises an elevated water supply, steam collector drum having a plurality of depending heat exchange tubes. The tubes are all connected to the elevated drum in a manner to allow irregular expansion of the tubes due to non-uniform combustion in the furnace. In the preferred embodiment designed with ease of mounting and replacement of tubes as the primary concerns, the boiler tubes are constructed with a feed water supply tube within an outer evaporator tube. In this arrangement cooler feed water is supplied within the evaporator tube and hot water and steam is returned to the drum through the evaporator tube. The drum is arranged on a support such that the tubes depend from the lower side of the drum. In the preferred embodiment of this design, the drum is mounted external to the furnace with vertical depending tubes inserted through holes in the top of a furnace. The entire drum and tube system can be thereby easily removed for replacement. In a furnace system utilizing a plurality of such single drum boilers, a boiler unit can be selectively removed and replaced in cartridge fashion.

In an alternate embodiment in which efficiency of the system is the prime concern, a single elevated water supply, steam collector drum is supported with depending tubes that make a looped circuit below the drum. In this manner each tube is connected at each end to the drum. The tube loop is oriented such that the hot returned portion of the loop is positioned closer to the central portion of the furnace than the cooler supply portion of the tube loop. A normal convection circuit is thereby created whereby the need for a circulating pump is eliminated. The single drum design of the boiler greatly facilitates the removal and replacement of individual tubes. Tubes in the devices herein described do not have to be precisely cut and bent to fit between the two spaced drums of prior art devices. These and other features of the invented boiler device are described in greater detail in the detailed description of the preferred embodiments hereafter.

DETAILED DESCRIPTION OF THE PREFERRED EMBODIMENTS

Figure 1:
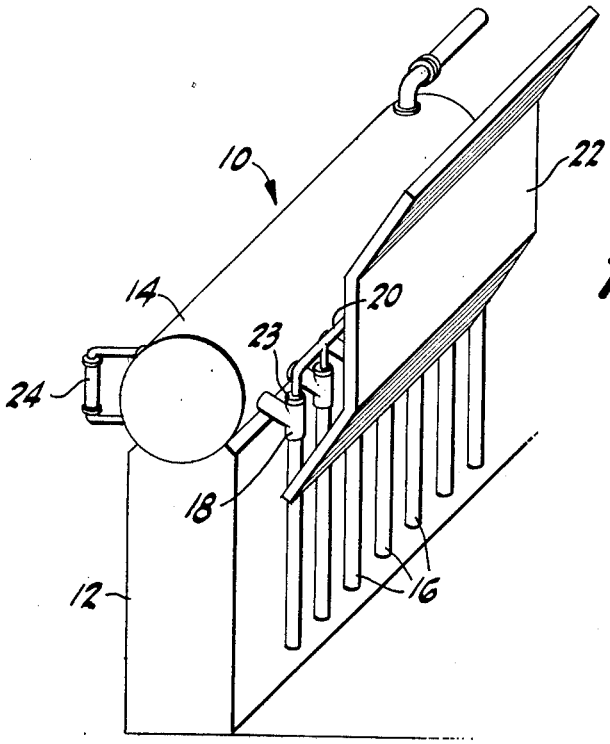
FIG. 1 is a perspective view of a first embodiment boiler with support and shield devices.

Referring to FIG. 1 the boiler, designated generally by the reference 10 is shown mounted on a solid support 12 comprising a portion of one of the four walls of a furnace. The boiler 10 includes a large diameter water supply, steam collector drum 14 from which depend a plurality of tubes 16.

It is contemplated that the furnace accomodate four such boilers arranged about each of the four walls of a substantially square furnace area. In an operating system it is considered appropriate to utilize a number of such boilers wherein one boiler is removed from the furnace for repairs in a rotational fashion during the life of the system. Since it is contemplated that removal and replacement time for an entire boiler is approximately four hours, when cooling and stocking time are considered the system can be kept in continuous operation for a period of many months with a single day downtime for boiler replacement.

The boiler of FIG. 1 is designed with the tubes 16 depending from the lower side of the tank or drum 4 such that the dependent tubes do not interfere with the boiler support 12. This orientation is accomplished by a Y-fitting 18 welded to the side of the drum 14. The depending tubes 16 are threaded directly into the Y-fitting 18.

Also connected to the Y-fitting 18 is a water supply tubing 20. The supply tube 20 supplies water to each of the depending evaporator tubes 16. A depending portion of the supply tube 20 is centered within the evaporator tubes 16 by a packed bushing 23 at the top of the Y-fitting 18. The water supply tube and Y-fittings are protected from the intense radiant heat in the furnace by a shield 22. In this manner the heat is primarily directed at the evaporator tubes 16 depending below the shield 22. The elevated water drum 14 maintains a water level that can be monitored by the level of water in a glass water level column 24 attached to the back side of the boiler drum. The drum also collects steam that is generated in the depending evaporator tubes 16 which can be drawn from the boiler through steam supply line 26. The boiler can be equipped with other conventional accessories such as a safety valve and pressurized water supply line to supply water to the collector drum to maintain an adequate safe level of water.

Figure 2:
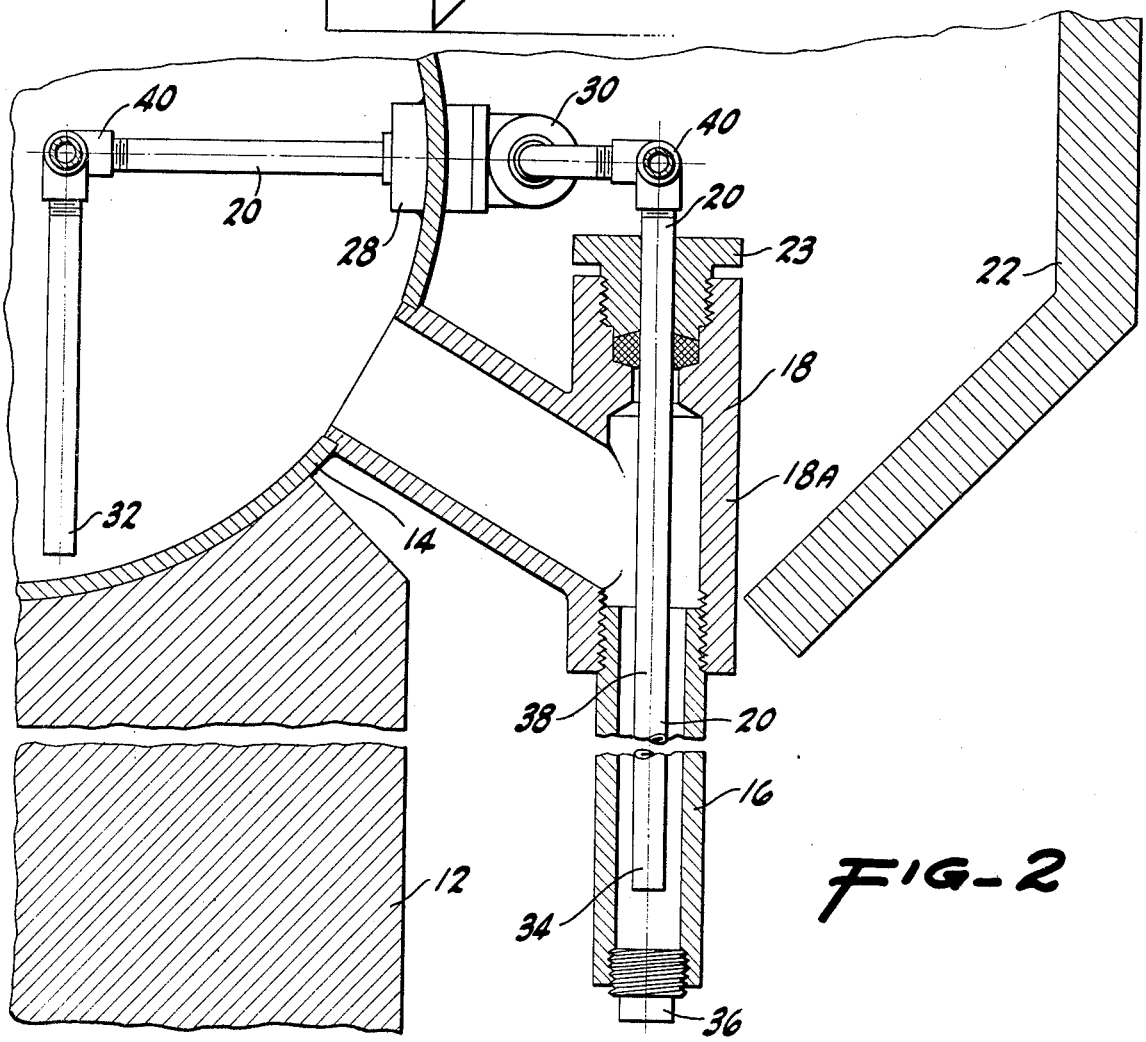
FIG. 2 is an enlarged cross-sectional view of a portion of the boiler, taken on the lines 2—2 in FIG. 1.

The arrangement of the water supply tube and the evaporator tubes is shown in greater detail in FIG. 2.

Referring to FIG. 2, the cross-section of the Y-fitting 18 reveals the arrangement of the inner water supply tube 20 which is concentrically arranged within the vertical portion 18A of the Y-fitting and the depending evaporator tube 16. As stated above, this orientation is maintained by the packing bushing 23. The packing bushing 23 provides a high pressure seal for the entering supply tube 20.

The supply tube 20 penetrates the boiler drum 14 through bushing 28 and circulating pump 30. The end 32 of supply tube 20 draws water from the lower portion of the boiler drum and circulates it to the opposite end 34 of the supply tube at the distal end of the evaporator tubes 16. In the presence of the intense furnace heat, a portion of this water is transformed into steam which bubbles up the evaporator tube and into the collector drum 14.

As shown in the cross-sectional view of FIG. 2, the evaporator tubes 16 can be easily withdrawn from the Y-fitting 18 by simple unthreading of the tube from the fitting. Sealing is preferably accomplished by natural corrosion from the selection of metals for the Y-fitting 18 and the evaporator tube 16 which are of different carbon content. The walls of the Y-fitting 18 at the thread are oversized in order to permit rethreading to accomodate replacement evaporator tubes.

The distal end of the evaporator tubes 16 are fitted with a drain plug 36 to allow easy draining of the evaporator tubes during flushing or other checks.

The water supply tube is fabricated from threaded piping for ease of replacement. For example, the depending portions 18 of the supply tube 20 may be removed and replaced by unthreading from the fittings 40 located adjacent and within the drum 14 after the evaporator tubes are removed.

Figure 3:
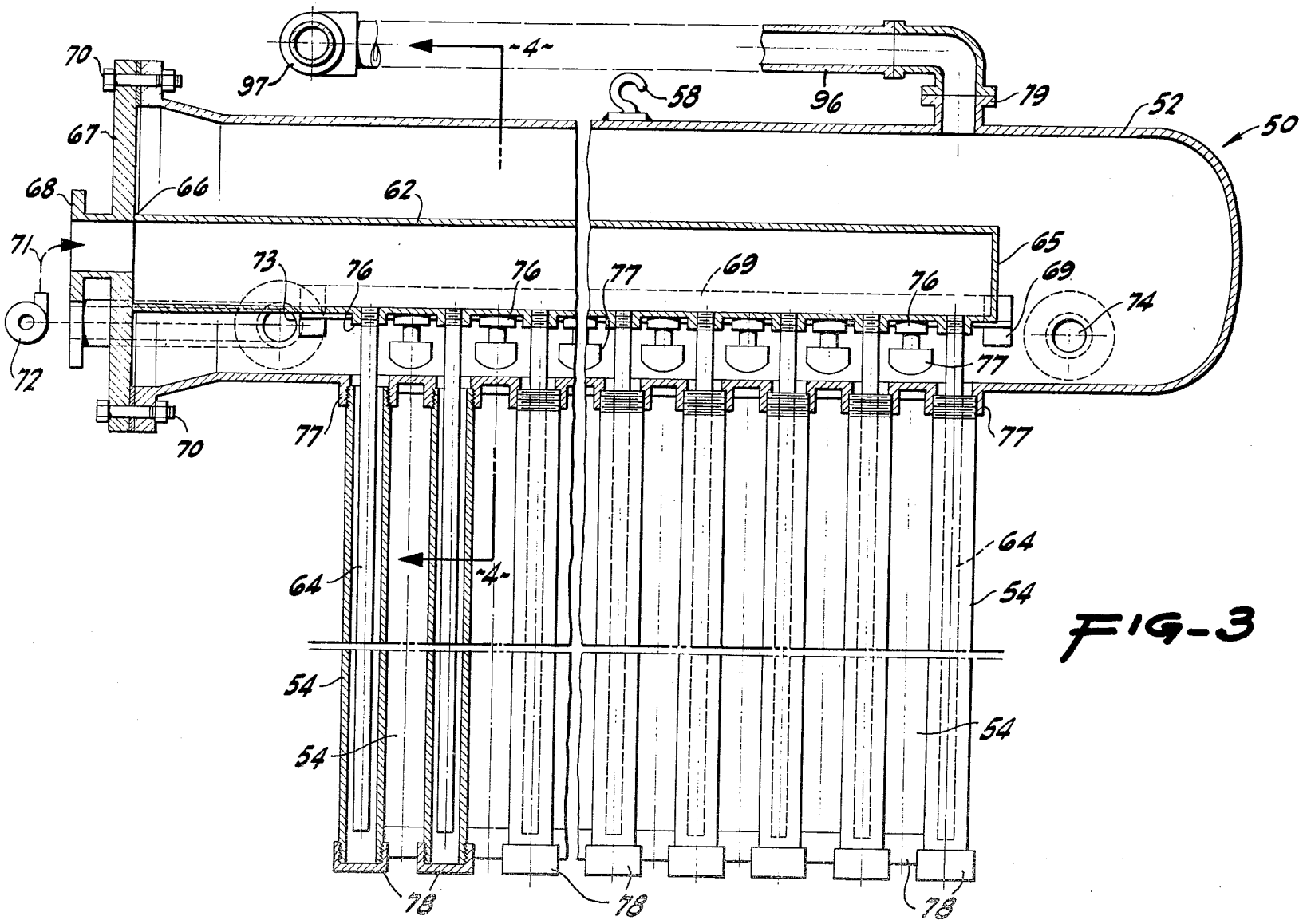
FIG. 3 is a cross-sectional view of an alternate embodiment of the boiler.
Figure 4:
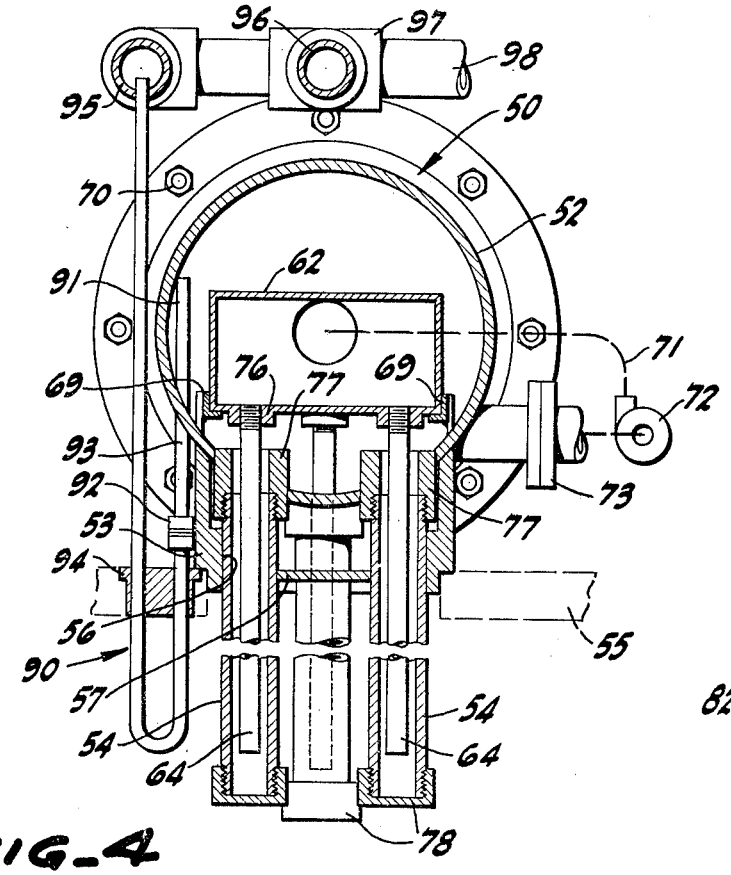
FIG. 4 is a cross-sectional view taken on the lines 4—4 in FIG. 3.

Referring now to FIG. 3, a second alternate embodiment of the devised boiler is shown. The boiler 50 is constructed with a similar collector drum 52 from which depend a plurality of evaporator tubes 54. The primary difference of the embodiment shown in FIG. 3 from that of FIG. 1 is that the evaporator tubes depend directly from the collector drum. The advantage of such arrangement is that the additional expense of Y-fittings is eliminated, and more importantly that by staggering the evaporator tubes as shown, an increased number of tubes can be connected by a given length of collector drum. Furthermore, the arrangement of evaporator tubes depending directly from the drum permits a novel "cartridge" system for mounting and operating the boilers in conjunction with a furnace. As shown in FIG. 4, the boiler drum 52 seats on a frame plug 53 which is fitted in an elongated slot in the top of an associated furnace 55 (a portion of which is shown in phantom). The boiler drum is thereby external to a furnace fire chamber which permits access for service and inspection. The depending tubes 54 insert through a slot 56 in the plug for entry into the furnace. A spacer plate 57 aids in aligning the depending tubes and forms a shield between tubes which cooperates with the plug to seal the boiler with respect to the furnace.

Since a supply drum may be in the range of 18 inches to 36 inches in diameter for most operations, and extend for 50 feet or more in length, the weight of the drum with the operational quantity of water is considerable. Because the drum is subjected to an operating pressure of approximately 250 p.s.i. at a steam temperature of approximately 400° F., the wall of the drum approaches one inch in thickness for larger sized boilers. Combined with the weight of the numerous depending tubes that may vary in length from approximately five feet in length to twenty or more feet in length, the weight of an empty boiler is itself considerable. The cradle support by the elongated frame-like plug distributes the weight of the boiler and provides an advantageous support with respect to an associated furnace.

Most importantly, in a furnace system utilizing a plurality of boilers of this design, each boiler becomes a cartridge that can be selectively removed and replaced. For example, in a furnace system having seven operational boilers, eight boilers would be used with one maintained in reserve for immediate replacement. The boiler is provided with a sky hook 58 for lifting the boiler from the furnace by crane for substitution. The reserve boiler can be immediately installed in such short order that the furnace need not be wholly shut down. This cartridge boiler system compensates for any lower unit operating efficiency as compared to double drum boilers, by raising substantially the overall system efficiency by minimizing down time of the power plant.

Within the drum 52 is an elongated manifold 62 for supplying circulation water to the many depending evaporator tubes 54. The manifold 62 is rectangular in cross section permitting three staggered rows of water circulating or supply tubes 64 to be fed by the single manifold 62. The manifold 62 has a closed end 65 and an opposite end 66 welded to the end cover 67 of the boiler drum 52 in conjunction with a water supply flange 68. The manifold 62 is supported on brackets 69 in a manner that permits the manifold and attached cover 67 to be slidably withdrawn from the drum 52 when the supply tubes 64 are disconnected and the cover bolts 70 are unfastened.

Water is supplied through the supply flange fitting 68 by a water line 71 and circulating pump 72, schematically represented in FIGS. 3 and 4, connected to a drum wall fitting 73 at the lower portion of the drum. A similar drum wall fitting 74 is connected to a replacement water supply for supplying return water and additional make-up water to the boiler system to compensate for water lost during operation.

The manifold is fitted with threaded ferrules 76 for the attachment of the threaded supply tubes 64 to the manifold. Similarly, the boiler drum 52 is fitted with threaded ferrules 77 for the attachment of the threaded evaporator tubes 54. The manifold is alignable with respect to the boiler drum such that the respective ferrules are aligned and the supply tubes when attached are concentrically positioned within the evaporator tubes. The open end supply tubes stop short of the ends of the evaporator tubes which are closed by caps 78. In this manner water circulated from the bottom of the boiler into the manifold and through the supply tubes is delivered to the evaporator tubes where it is heated and in part evaporated for the generation of steam. The steam rises in the evaporator tubes to the boiler drum where it is extracted through flange fitting 79 for use.

The boiler of FIGS. 3 and 4 includes other customary components to monitor temperature, pressures, and water levels, which are not shown to maintain a clarity of description in the drawings. One optional component for the boiler is shown, however. This comprises a heat charger for steam which is constructed with one or more steam loops 90 from the boiler into the furnace. As shown in FIG. 4, the steam loop 90 comprises a vertical pipe section 91 which penetrates and is fixed to the wall of the boiler and terminates in a steam zone above the top of the manifold 62 which corresponds, approximately to the maximum water level in the boiler. Customarily, the water zone of the boiler is maintained below the top of the manifold. Outside the boiler the vertical pipe section 91 is joined to a universal joint coupler 92 which allows for relief of expansion stresses and movements. The coupler 82 also connects to a pipe loop 93 which passes through a sealing plug 94 in the furnace 55 for exposure of the loop to fire chamber. The loop 93 returns to a delivery steam line 95 from the boiler for adding higher temperature steam to the bulk of the steam delivered from the boiler. While a single steam loop 90 is shown it is to be understood that a plurality of lines would be installed, the number depending on the ultimate use and temperature requirement for the steam. Using conventional valve controls the quantity of heat charged steam may be regulated by directing steam from boiler line 96 to tee 97 and through steam-loop manifold line 95 and/or direct line 98 in the proportion desired.

Figure 5:
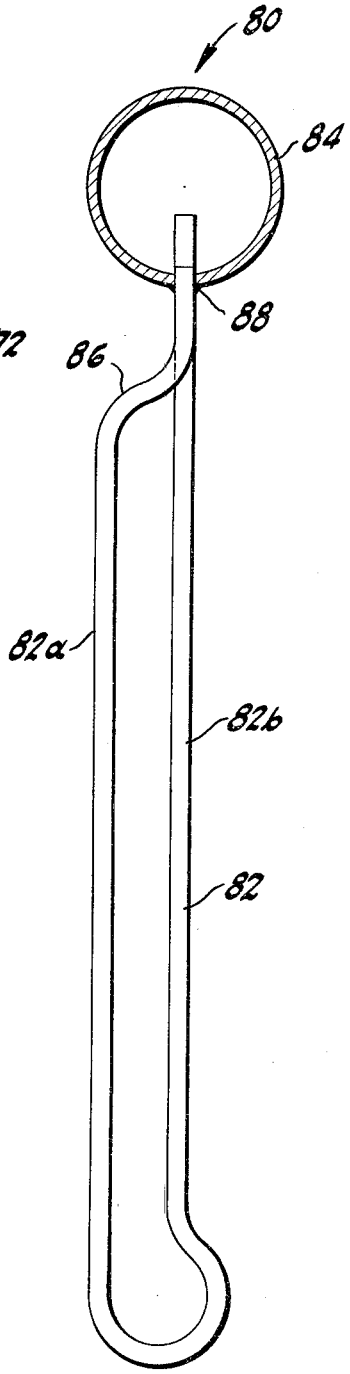
FIG. 5 is an end elevational view partially in cross-section of a further alternate embodiment of the invention.
Figure 6:
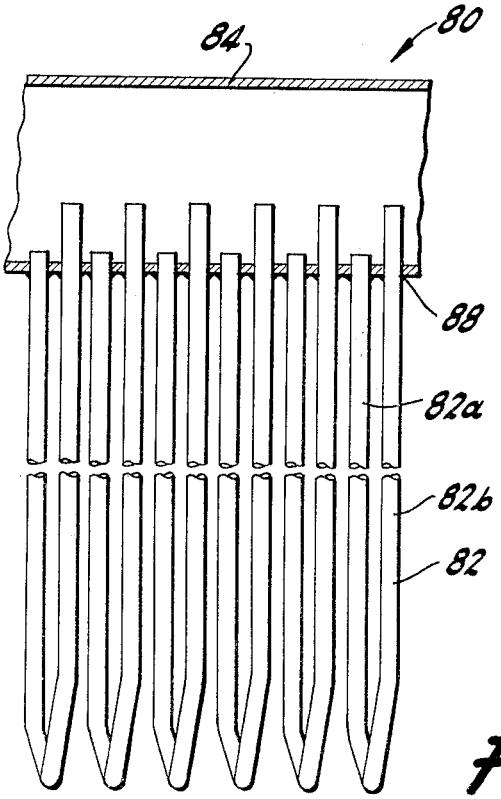
FIG. 6 is a side elevational view partially in cross-section of the alternate embodiment of FIG. 5.

Referring now to FIGS. 5 and 6, the boiler 80 shown therein is illustrated in part to depict only the principal distinguishing features of this boiler from the previous embodiments. The boiler 80 includes a plurality of depending tube loops 82 (one of which is shown in FIG. 6) fitted to an elevated drum 84. The tube loop is fixed at each end to the drum by welds in a manner that one end penetrates the drum 84 and is elevated from the opposite end. In this manner the natural temperature differential of water within the drum will cause a circulation effect within the tube with cooler water entering portion 82*a* and discharging through loop portion 82*b* after the water has been heated in the evaporator tube. To increase the effect of this ciculation pattern, the loop portion 82*b* is oriented such that it is closer to the central furnace area than the loop portion 82*a*. This is accomplished by placing a crook 86 in the loop portion 82*a*.

While the boiler embodiment of FIGS. 5 and 6 has certain disadvantages in replacement of tubes, the efficiency of the boiler may be somewhat improved and the need for an internal water supply tube system is eliminated. To replace the depending tube loops 82 a weld 88 at the top of each portion must be broken. However, the replacement of the tube loops in the overhead boiler system of this invention is substantially less difficult than replacement of a tube connected at the ends to an upper and lower boiler drum arrangement.

While in the foregoing specification embodiments of the invention have been set forth in considerable detail for the purposes of making a complete disclosure of the invention, it will be apparent to those of ordinary skill in the art the numerous changes may be made in such details without departing from the spirit and principals of the invention.

What is claimed is:

1. A boiler for generating steam comprising a single boiler drum having a cylindrical configuration with a central axis, an upper portion and a lower portion, said boiler drum being mounted in an elevated position in a furnace structure with its axis substantially horizontal and, a plurality of depending boiler tubes connected to the underside of the boiler drum constructed substantially perpendicular to the central axis of the drum and arranged for placement within a furnace, wherein said boiler tubes each have a terminating end below said drum, each boiler tube comprising an outer evaporator tube and an inner water supply tube positioned within each evaporator tube, wherein cooler supply water is circulated from said boiler drum through said inner water supply tubes to said end of said boiler tubes and into said outer evaporator tubes for return of steam and hotter water to said boiler drum.

2. The boiler of claim 1 wherein said water supply tube within each evaporator tube is connected to a manifold means within said boiler drum for drawing cooler water from said boiler drum and circulating the water to said evaporator tube.

3. The boiler of claim 2 wherein said manifold means includes a circulating pump.

4. The boiler of claim 1 wherein said depending evaporator tubes are connected to said drum by a threaded connection.

5. The boiler of claim 4 wherein said threaded connection includes a fitting attached to said drum having overthick thread walls adapted for rethreading.

6. The boiler of claim 5 wherein said fitting comprises a Y-fitting having a top bushing, each water supply tube being inserted through said bushing an concentrically oriented within said evaporator tube by said bushing.

7. The boiler of claim 1 wherein said boiler is supported by a wall support interfacing the underside of the drum.

8. The boiler of claim 2 wherein said evaporator tubes and supply tubes depend directly from said drum in a straight line.

9. The boiler of claim 8 wherein said boiler includes an elongated manifold mounted within said drum, said supply tubes having an upper end connected to said manifold.

10. The boiler of claim 9 wherein said boiler includes a support means mountable on the top of an associated furnace structure for supporting said drum external to said furnace, said depending evaporator tubes passing through said support means and into the associated furnace structure.

11. The boiler of claim 9 wherein said boiler includes a heat charger for boiler steam comprising a steam circuit conduit which penetrates the boiler drum, the boiler drum having a water zone, and a steam zone above the water zone, said boiler having a steam delivery line from the boiler connected to said drum in the steam zone, wherein said steam circuit conduit has a first end which terminates in the steam zone, a loop section which loops within the associated furnace and a second end which connects to said steam delivery line from the boiler.

12. The boiler of claim 9 wherein said heat charger includes a plurality of steam circuit conduits, each conduit including a universal joint connector proximate said first end of said conduits external of said drum.

* * * * *